US011879377B2

(12) United States Patent
Kroon et al.

(10) Patent No.: US 11,879,377 B2
(45) Date of Patent: Jan. 23, 2024

(54) CRANKSHAFT MOUNTED PUMP

(71) Applicant: Volvo Car Corporation, Gothenburg (SE)

(72) Inventors: Peter Kroon, Gothenburg (SE); Mattias Svensson, Säve (SE)

(73) Assignee: Volvo Car Corporation, Gothenburg (SE)

( * ) Notice: Subject to any disclaimer, the term of this patent is extended or adjusted under 35 U.S.C. 154(b) by 0 days.

(21) Appl. No.: 17/679,375

(22) Filed: Feb. 24, 2022

(65) Prior Publication Data

US 2022/0282661 A1 Sep. 8, 2022

(30) Foreign Application Priority Data

Mar. 4, 2021 (EP) ..... 21160822

(51) Int. Cl.
*F01P 5/12* (2006.01)
*F04D 1/00* (2006.01)
*F04D 29/20* (2006.01)

(52) U.S. Cl.
CPC ..... *F01P 5/12* (2013.01); *F04D 1/00* (2013.01); *F04D 29/20* (2013.01)

(58) Field of Classification Search
CPC ..... F04D 1/00; F04D 29/20; F04D 5/12
See application file for complete search history.

(56) References Cited

U.S. PATENT DOCUMENTS 1,366,149 A 1/1921 Applin
2,214,243 A * 9/1940 Casson ..... F04D 29/126 123/41.46

FOREIGN PATENT DOCUMENTS

GB 856616 A 12/1960
GB 2042075 A 9/1980

OTHER PUBLICATIONS

Jul. 8, 2021 European Search Report issued in International Application No. 21160822.9.

* cited by examiner

*Primary Examiner* — Kevin A Lathers
(74) *Attorney, Agent, or Firm* — Clements Bernard Walker; Christopher L. Bernard

(57) ABSTRACT

A system including an engine block and a crankshaft able to rotate around axis A, and a pump with an impeller, the impeller mounted coaxially to the crankshaft such that the crankshaft drives the impeller. The system can be part of an engine for a vehicle, and the pump can drive water or other coolant through the engine.

20 Claims, 3 Drawing Sheets

CRANKSHAFT MOUNTED PUMP

CROSS-REFERENCE TO RELATED APPLICATION

The present disclosure claims the benefit of priority of co-pending European Patent Application No. 21160822.9, filed on Mar. 4, 2021, and entitled "CRANKSHAFT MOUNTED PUMP," the contents of which are incorporated in full by reference herein.

TECHNICAL FIELD

The present disclosure is related to engines, and in particular engines with a mechanical coolant pump.

BACKGROUND

Modern engines are a collection of complex and dependent subsystems which must fit in a compact space. Vehicle engine operations often result in high temperatures, and to avoid the overheating of engines, cooling systems are used in the engine. Since liquid coolant (instead of air) started to be used to cool engines, pumps have been needed to circulate that fluid. In current systems, a mechanical pump is typically driven by the alternator belt, cam belt or another auxiliary belt to pump the liquid through the engine. This belt is usually driven directly or indirectly by the crankshaft of the engine. Alternatively, electric pumps can be used, though these are typically more expensive and less powerful.

SUMMARY

According to a first aspect of the disclosure, a system includes an engine block with a crankshaft able to rotate around axis A, and a pump with an impeller, the impeller coaxially mounted to the crankshaft such that the crankshaft drives the impeller. Such a system results in a compact package with the crankshaft able to directly drive the pump impeller, eliminating the need for separate components (e.g., belts) and extra space to accommodate the extra components and drive the pump. Overall this configuration saves package space, reduces complexity and dependencies while providing a reliable and efficient system for a pump to cool an engine.

According to an embodiment, the crankshaft has a first end, and the impeller is mounted at or near the first end. In other embodiments, the impeller can be mounted a distance from the end. Optionally, the impeller is mounted adjacent to the engine block. By mounting the impeller directly to the crankshaft, the overall engine package with the pump can be more compact and require fewer parts.

According to an embodiment, the pump includes a housing, an inlet and an outlet. Optionally, the housing is mounted to the engine block. Further optionally, the housing is mounted to the engine block with bolts. Such a configuration can allow for simple manufacture of the pump and housing, with simple and secure connections to the engine block such that the impeller can be mounted to the crankshaft.

According to an embodiment, the housing is integral with the engine block. This means that part or all of the housing is formed with the engine block such that it is not able to be removed. This can be, for example, through casting, moulding and/or machining. Such a configuration is simple, having fewer parts, and can save assembly time and costs as the housing does not need to be separately produced and then secured to the engine block. Optionally, the housing includes a lid. This can allow for easy access to the inner parts of a pump housing even when formed integrally with the engine block.

According to an embodiment, the impeller is mounted to the crankshaft via one or more of the following: shrink fit, splined connection, friction gasket, press-fit, and friction washer. Such connections and/or components help to ensure a secure connection between the crankshaft and pump impeller such that the rotation of the crankshaft rotates the impeller, thereby driving the pump. These connections can also help to ensure there is little to no slippage so that the impeller is driven at the desired revolutions per minute ("RPM") with the crankshaft.

According to an embodiment, the pump is a water pump. Such a mechanically driven water pump is useful for cooling an engine, and can generally provide more power while taking up less space than prior art alternatives, such as belt-driven mechanical water pumps and electric water pumps.

According to an embodiment, the system further includes one or more seals. Such seals can be shaft seals, lip seals or any types of seals which provide sealing around the pump and the engine such that fluid from the pump does not leak into the surroundings and oil from the engine block does not leak out.

According to a further aspect of the disclosure, a method includes obtaining an engine block with a crankshaft; and mounting an impeller of a pump to the crankshaft coaxially with the crankshaft such that crankshaft rotation directly drives the impeller. Such a method provides a compact and reliable way of delivering cooling fluid to an engine block from a pump while minimizing the parts, complexity and space needed for driving the pump.

According to an embodiment, the method further includes mounting a housing of the pump to the engine block. This can be with bolts, screws, welding and/or any other means of securely mounting the housing. By mounting the housing to the engine block, the impeller can be mounted securely to the crankshaft such that no additional belt or other component is needed for driving the pump. Additionally, the fluid being pumped does not need to travel as far when mounted directly to the engine block. Alternatively, the pump housing could be formed integral with the engine block, minimizing separate parts even further and reducing assembly time.

According to an embodiment, the method further includes arranging one or more seals between the pump and the crankshaft. Such seals can be shaft seals, lip seals or other types of seals which can ensure sealing between the pump, shaft and engine block and thereby reduce the chances of fluid leakage from the pump and/or the engine.

According to an embodiment, the step of mounting a pump with an impeller to the crankshaft includes mounting via one or more of the following: shrink fit, splined connection, friction gasket, press-fit, and friction washer. Such mounting options can ensure a secure and reliable connections such that the rotation of the crankshaft rotates the impeller without slippage, thereby driving the impeller and pump at the desired RPM.

The details of one or more examples are set forth in the accompanying drawings and the description below. Other features, objects, and advantages of the disclosure will be apparent from the description and drawings, and from the claims.

DETAILED DESCRIPTION

Figure 1A:
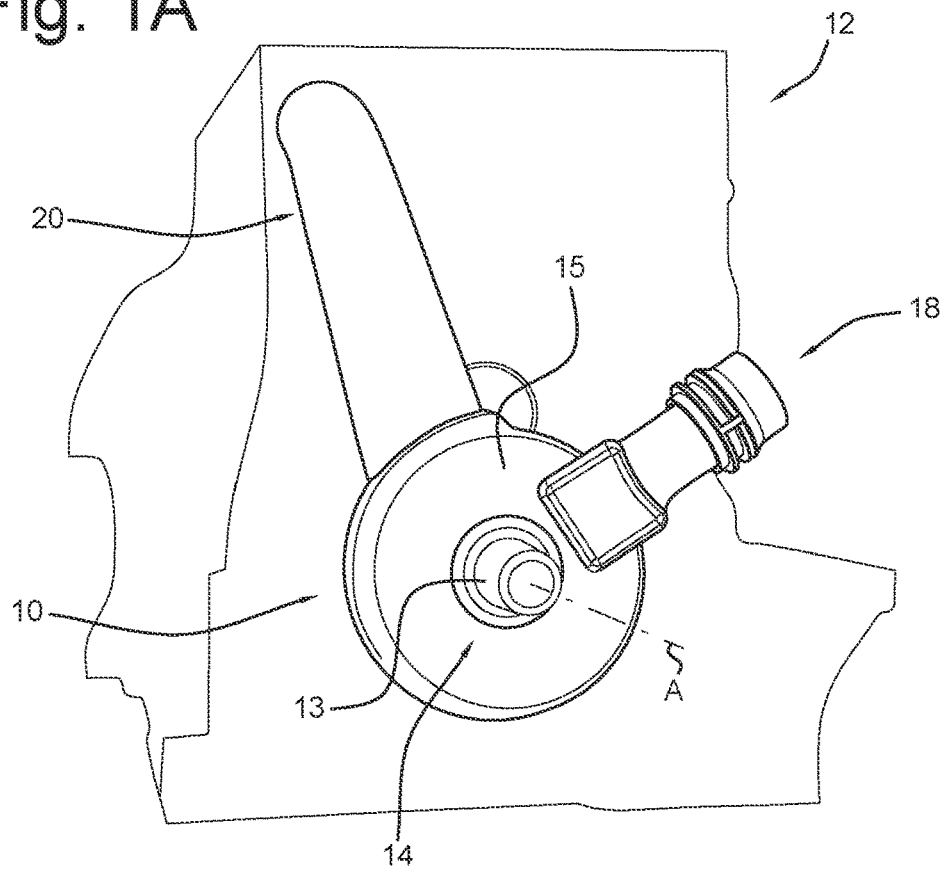
FIG. 1A is a perspective view of a pump connected to an engine block and crankshaft.
Figure 1B:
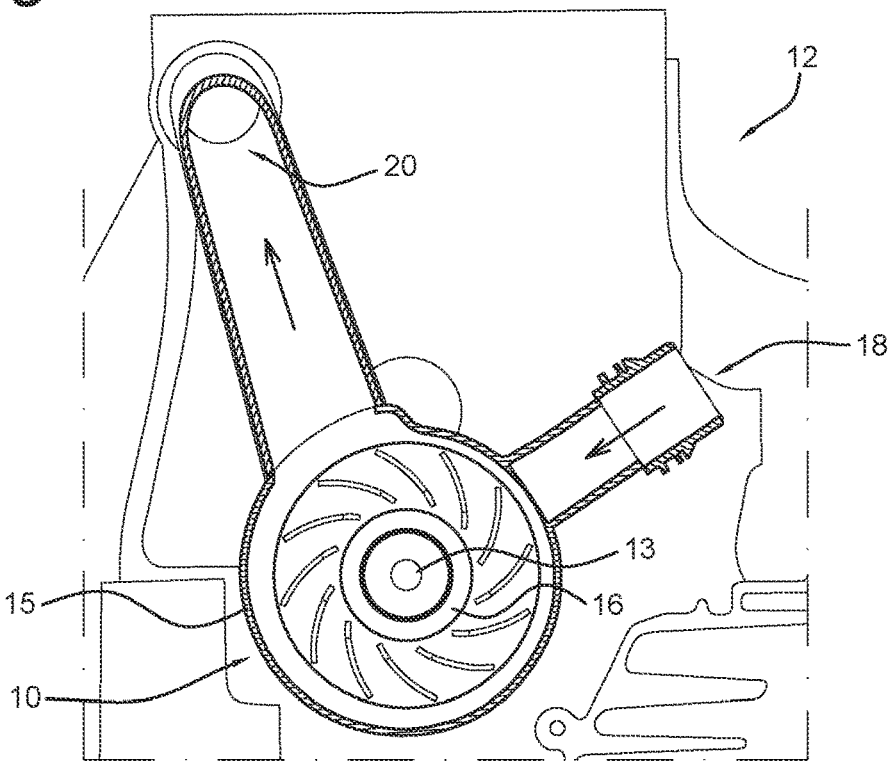
FIG. 1B is a cross-sectional view of the pump.
Figure 1C:
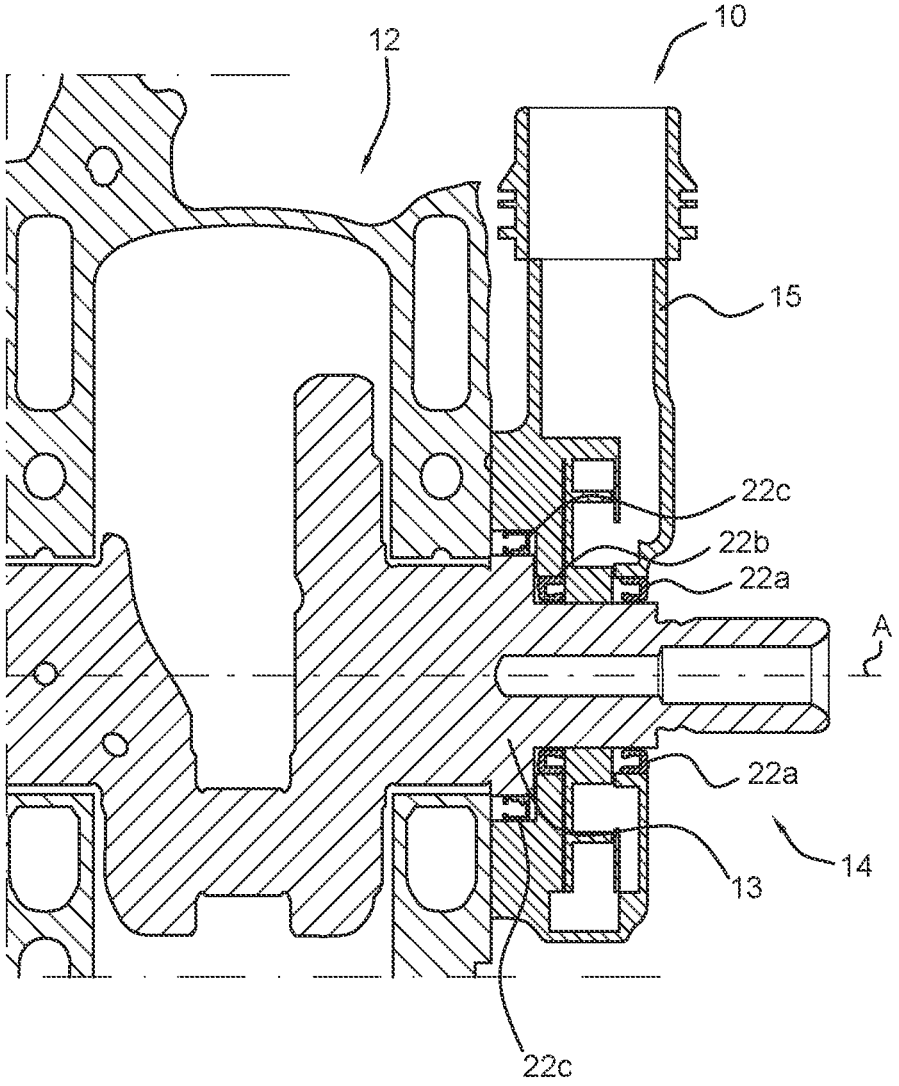
FIG. 1C is a cross-sectional view through the pump and a portion of the engine block and crank shaft.

FIG. 1A is a perspective view of a pump 10 connected to an engine block 12 and crankshaft 13; FIG. 1B is a cross-sectional view of the pump 10; and FIG. 1C is a cross-sectional view through the pump 10 and a portion of the engine block 12 and crankshaft 13. Crankshaft 13 includes end 14, which extends out of engine block 12. Engine block 12 is part of an engine, for example, for a vehicle. Crankshaft 13 rotates around axis A.

Pump 10 can be a pump for water or other coolant, and includes housing 15 and impeller 16. Also shown are inlet 18, outlet 20, and seals 22*a*, 22*b*, 22*c*. Inlet 18 and/or outlet 20 can be part of pump 10 housing 15 or can be separate parts, simply connecting to pump housing 15. Inlet 18 and/or outlet 20 can be formed as pictured, though in addition or in alternative to the connections shown, could have hoses, seals and/or other components necessary to make the sealing connections for receiving and delivering fluid from pump 10.

Seals 22*a*, 22*b*, 22*c* can be shaft seals, lip seals or other types of seals which can ensure sealing between the pump 10, crankshaft 13 and engine block 12. More or fewer seals could be included, and/or seal placement could be varied depending on the specific engine and pump configuration.

Housing 15 is connected to an outside of the engine block 12, for example by bolts, screws or other means. Inlet 18 is where coolant enters pump 10, flowing into the housing 15, where it is driven by impeller 16. The coolant exits pump housing 15 through outlet 20 into the engine block 12 to cool various engine components. Typically the pump housing 15 would be plastic or aluminium (including alloys and composites) though could be other types of materials. Impeller 16 could be formed of a metallic material such as steel or brass, or could be formed of a plastic or other materials which can be directly and securely connected to crankshaft 13.

Impeller 16 of pump 10 connects directly to and coaxially to crankshaft 13. This connection is adjacent to engine block 12, and typically at or near end 14 of crankshaft, though in some embodiments this could be a distance from end 14. This connection is formed such that the rotation of crankshaft 13 rotates impeller 16, driving pump 10. The connection can be through a splined connection, shrink fit, friction gasket, press-fit, friction washer and/or any other connection or component which securely connects impeller 16 to crankshaft 13 such that it will rotate with the rotation of crankshaft 13 with little to no slippage. This will ensure that the pump 10 impeller 16 is driven at the desired RPM for properly driving fluid from pump 10 to cool the engine.

By securing pump 10 housing 15 to the outside of the engine block 12 such that pump 10 is aligned coaxially with crankshaft 13 and impeller 16 is directly connected to crankshaft 16, pump 10 is able to be directly driven by crankshaft 13. This frees up more space in the overall engine package, allowing for more flexibility in other systems and the vehicle engine as a whole. As mentioned in the background, past systems used pumps which were typically driven by the alternator belt or another belt which looped through the engine and connected to the crankshaft. By directly and coaxially connecting the pump 10 to the crankshaft, more engine space is freed-up. This could be used to add other desirable systems to the engine and/or reduce the size of the overall engine thereby improving the efficiency of the vehicle. Such a configuration is especially useful in electrified engines where system components are generally larger and some components which necessitated belts (e.g., alternators) are no longer used.

Figure 2A:
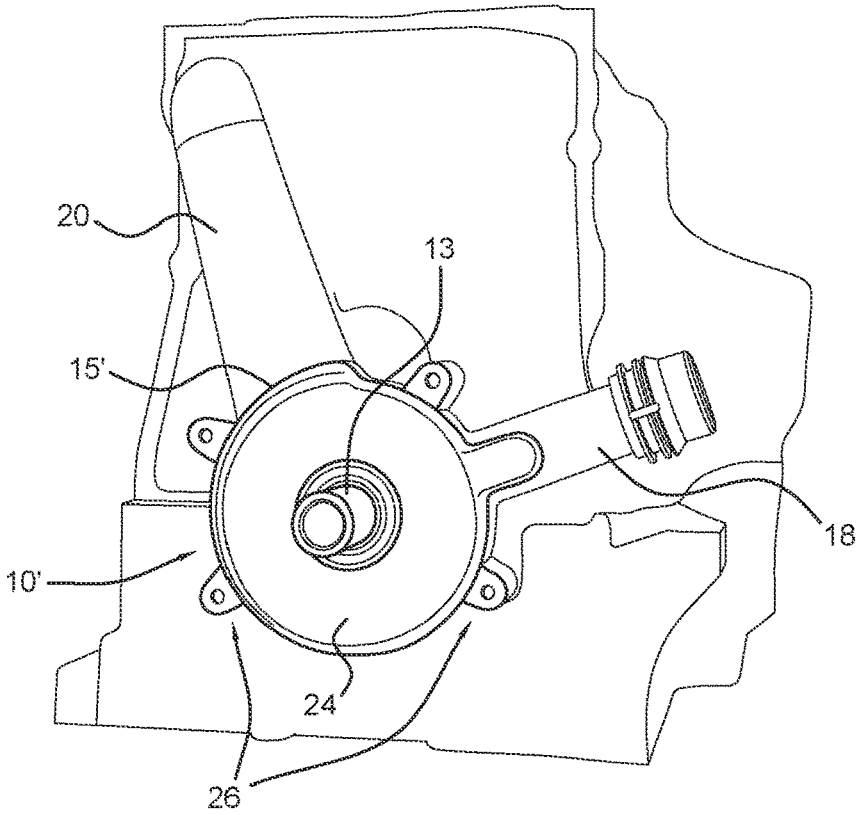
FIG. 2A is a perspective view of a pump integrated into the engine block.
Figure 2B:
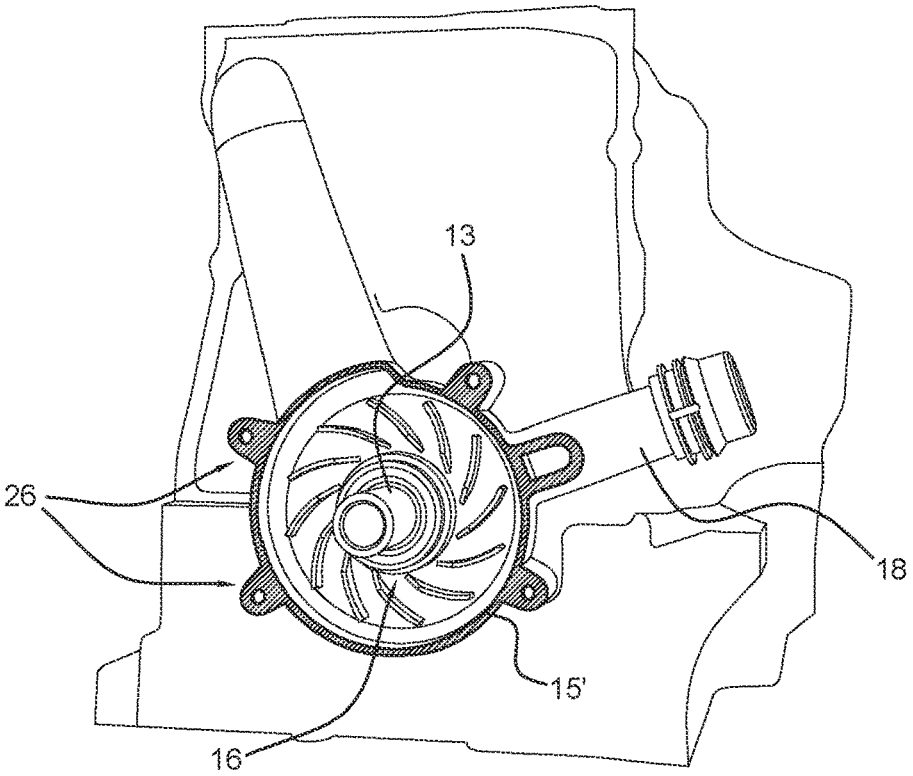
FIG. 2B is a view of the pump of FIG. 2A with a lid removed.

FIG. 2A is a perspective view of a water pump 10' integrated into the engine block 12, and FIG. 2B is a view of the pump 10' with the lid 24 removed. Similar numbers are used for similar components, and only the differences will be discussed.

In this embodiment, pump 10' housing 15' is formed integrally into engine block 12 such that the pump housing is not a separate part. Pump 10' includes a lid 24 for pump 10' access. This lid is connected by connection members (e.g., screws, bolts, pins) through connection flanges 26, though could be secured in other manners, for example, snap fit, etc. Inlet 18 and/or outlet 20 can be formed integrally as shown in FIGS. 2A-2B, or can be separate parts, for example, hoses connecting to pump 10' to carry fluid into and out of pump 10'.

Forming pump 10' housing integral to engine block 12 can result in even more space savings in the overall engine as well as assembly time savings in not having to separately connect the water pump housing to the engine block. A lid can simply be connected for access to the interior, for example, for easy inspection and maintenance purposes.

Pump 10' connects impeller 16 directly to and coaxially to crankshaft 13 such that the rotation of crankshaft 13 rotates impeller 16, as in pump 10 shown in FIGS. 1*a*-1C. Thus, in pump 10', as in pump 10 of FIGS. 1*a*-1*c*, the pump is able to be driven directly by the crankshaft 13 without the need for additional belts or other secondary (or more) drive systems and components. Mounting the impeller 16 of pump 10, 10' coaxially and directly to crankshaft 13 saves package space, reduces complexity and dependencies, and removes the need for additional systems and components. This makes for an overall reliable, compact and efficient configuration.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular or preferred embodiments disclosed, but that the disclosure will include all embodiments falling within the scope of the appended claims.

The invention claimed is:

1. A system, comprising:

an engine block and a crankshaft able to rotate around axis A, the crankshaft having a length with opposing first and second ends, wherein the first end is a free end that extends out of the engine block and the second end is connected to the engine block, and a pump with an impeller, the impeller mounted directly and coaxially to the crankshaft such that the crankshaft drives the impeller, wherein the pump is arranged between the engine block and the free end.

2. The system of claim 1, wherein the impeller is mounted at or near the free end.

3. The system of claim 1, wherein the impeller is mounted adjacent to the engine block.

4. The system of claim 1, wherein the pump comprises a housing, an inlet and an outlet.

5. The system of claim 4, wherein the housing is mounted to the engine block.

6. The system of claim 5, wherein the housing is mounted to the engine block with bolts.

7. The system of claim 4, wherein the housing is integral with the engine block.

8. The system of claim 7, wherein the housing comprises a lid.

9. The system of claim 1, wherein the impeller is mounted to the crankshaft via one or more of the following: a shrink fit, a splined connection, a friction gasket, a press-fit, and a friction washer.

10. The system of claim 1, wherein the pump is a water pump.

11. The system of claim 1, further comprising one or more seals.

12. A method, comprising:

providing an engine block with a crankshaft, the crankshaft having a length with opposing first and second ends, wherein the first end is a free end that extends out of the engine block and the second end is connected to the engine block; and mounting a pump with an impeller to the crankshaft directly and coaxially with the crankshaft such that crankshaft rotation directly drives the impeller, wherein the pump is arranged between the engine block and the free end.

13. The method of claim 12, further comprising mounting a housing of the pump to the engine block.

14. The method of claim 12, further comprising arranging one or more seals between the pump and the crankshaft.

15. The method of claim 12, wherein the step of mounting the pump with the impeller to the crankshaft comprises mounting via one or more of the following: a shrink fit, a splined connection, a friction gasket, a press-fit, and a friction washer.

16. A vehicle, comprising:

an engine block and a crankshaft able to rotate around axis A, the crankshaft having a length with opposing first and second ends, wherein the first end is a free end that extends out of the engine block and the second end is connected to the engine block, and a pump with an impeller, the impeller mounted directly and coaxially to the crankshaft such that the crankshaft drives the impeller, wherein the pump is arranged between the engine block and the free end.

17. The vehicle of claim 16, wherein the impeller is mounted adjacent to the engine block.

18. The vehicle of claim 16, wherein the pump comprises a housing mounted to or integral with the engine block, an inlet and an outlet.

19. The vehicle of claim 18, wherein the housing comprises a lid.

20. The vehicle of claim 16, wherein the impeller is mounted to the crankshaft via one or more of the following: a shrink fit, a splined connection, a friction gasket, a press-fit, and a friction washer.

* * * * *